US011147323B1

(12) United States Patent
Wilson

(10) Patent No.: US 11,147,323 B1
(45) **Date of Patent: *Oct. 19, 2021**

(54) PROTECTIVE FACE SHIELD ATTACHABLE TO HEADWEAR

(71) Applicant: Racing Optics, Inc., Las Vegas, NV (US)

(72) Inventor: Bart E. Wilson, Las Vegas, NV (US)

(73) Assignee: Racing Optics, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/874,609

(22) Filed: May 14, 2020

Related U.S. Application Data

(63) Continuation-in-part of application No. 29/733,809, filed on May 6, 2020.

(60) Provisional application No. 63/011,864, filed on Apr. 17, 2020.

(51) Int. Cl.
*A41D 13/11* (2006.01)
*A42B 3/22* (2006.01)

(52) U.S. Cl.
CPC ..... *A41D 13/1184* (2013.01); *A42B 3/225* (2013.01)

(58) Field of Classification Search
CPC ..... A41D 13/1184; A41D 13/1161; A41D 13/1169; A42B 1/006; A42B 1/062; A42B 1/064; A42B 1/067; A42B 1/205; A42B 1/247; A42B 1/24; A42B 3/22; A42B 3/221; A42B 3/226; A42B 3/20; A42B 3/18; A61F 9/029; A61F 9/06; G02C 3/02; G02C 7/16; A61B 90/05
USPC ..... 128/857, 858; D29/110
See application file for complete search history.

(56) References Cited

U.S. PATENT DOCUMENTS 1,337,036 A 4/1920 Bergmann
1,366,907 A 2/1921 Dunand
2,138,086 A * 11/1938 Olav ..... A42B 1/064 2/10
2,248,331 A 7/1941 Blodjer
(Continued)

FOREIGN PATENT DOCUMENTS

AU 2005244595 A1 7/2006
DE 202004010014 U1 4/2005

OTHER PUBLICATIONS

Instashield LLC, Bionic Wrench® Inventor Creates Low-Cost Face Shield for Masses, Apr. 15, 2020, 3 pages.
(Continued)

*Primary Examiner* — Heather Mangine
(74) *Attorney, Agent, or Firm* — Stetina Brunda Garred Brucker

(57) ABSTRACT

A protective shield is provided for use with headwear having a brim and wearable by a user. The protective shield includes an elongate suspension strap portion and a pair of attachment tabs engageable with the headwear and positioned such that the elongate suspension strap portion extends between the pair of attachment tabs. A protective portion is connected to the suspension strap portion and is configured to extend over the user's eyes, nose, and mouth when the protective shield is attached to the headwear. The suspension strap portion and the protective portion collectively define a slot sized to receive the brim of the headwear to facilitate engagement between the protective shield and the headwear.

20 Claims, 8 Drawing Sheets

(56) References Cited

U.S. PATENT DOCUMENTS 2,328,687 A * 9/1943 Serr ..... A42B 1/062 2/10
2,339,280 A 1/1944 Roy
2,354,415 A 7/1944 Woodard
2,461,604 A 2/1949 Huntsman
2,546,117 A 3/1951 Whelan
2,563,125 A 8/1951 Malcom, Jr.
2,569,715 A 10/1951 Green
2,963,708 A 12/1960 Herbine
3,095,575 A 7/1963 Radov
3,298,031 A 1/1967 Joseph
3,475,766 A 11/1969 Raschke
3,577,565 A * 5/1971 Feldmann ..... A42B 3/225 2/10
3,605,115 A * 9/1971 Bohner ..... A42B 3/225 2/10
3,685,054 A * 8/1972 Raschke ..... A42B 3/225 2/10
3,774,239 A * 11/1973 Kotzar ..... A42B 3/221 2/10
3,797,042 A * 3/1974 Gager, Jr. ..... A42B 3/222 2/10
4,063,740 A * 12/1977 Mader ..... A63B 69/3608 473/210
D249,597 S 9/1978 Dillon
D254,638 S 4/1980 Bay, Jr.
4,625,341 A * 12/1986 Broersma ..... A42B 3/227 2/10
4,701,965 A * 10/1987 Landis ..... A41D 13/11 2/428
4,726,074 A * 2/1988 Baclit ..... A42B 1/247 2/10
D299,767 S 2/1989 Hsin
4,850,049 A 7/1989 Landis
4,852,185 A 8/1989 Olson
4,852,186 A 8/1989 Landis
4,853,974 A * 8/1989 Olim ..... A41D 13/1184 2/9
4,856,535 A * 8/1989 Forbes ..... A41D 13/1176 128/857
4,864,653 A * 9/1989 Landis ..... A61F 9/02 2/9
4,867,178 A * 9/1989 Smith ..... A41D 13/1184 128/858
4,884,296 A 12/1989 Nix, Jr.
4,884,302 A * 12/1989 Foehl ..... A42B 3/222 2/424
D306,363 S 2/1990 Stackhouse
D307,065 S 4/1990 Friedman
4,920,576 A 5/1990 Landis
4,945,573 A * 8/1990 Landis ..... A61F 9/02 128/863
4,950,445 A * 8/1990 Salce ..... A41D 13/1146 264/2.7
4,964,171 A 10/1990 Landis
4,965,887 A * 10/1990 Paoluccio ..... A61F 9/02 128/201.25
4,975,981 A * 12/1990 Ray ..... A42B 3/225 2/10
D318,147 S 7/1991 Russell
5,035,004 A * 7/1991 Koester ..... A42B 1/062 2/206
D319,449 S 8/1991 Millar
5,046,195 A * 9/1991 Koritan ..... A41D 13/0512 2/172
D321,268 S 10/1991 Nix, Jr.
5,052,054 A * 10/1991 Birum ..... A42B 1/061 2/10
5,113,528 A 5/1992 Burke, Jr.
D331,820 S 12/1992 Scanlon
5,201,077 A * 4/1993 Dondlinger ..... A42B 1/067 2/172
5,206,956 A * 5/1993 Olson ..... A61F 9/02 128/857
5,208,916 A * 5/1993 Kelman ..... A42B 1/247 2/10
D349,177 S 7/1994 Russell
D349,178 S 7/1994 Russell
D349,362 S 8/1994 Russell
5,365,615 A * 11/1994 Piszkin ..... A42B 3/22 2/10
D353,691 S 12/1994 Scanlon
D354,588 S 1/1995 Russell
D354,589 S 1/1995 Russell
D359,586 S * 6/1995 Lofton ..... D29/110
D361,160 S 8/1995 Russell
D362,086 S 9/1995 Russell
5,473,778 A * 12/1995 Bell ..... A42B 1/247 2/10
5,544,361 A 8/1996 Fine
5,553,608 A * 9/1996 Reese ..... A41D 13/1115 128/206.19
5,555,570 A * 9/1996 Bay, Jr. ..... A42B 3/185 2/422
5,673,431 A * 10/1997 Batty ..... A42B 3/225 2/10
5,687,420 A * 11/1997 Chong ..... A42B 1/247 2/10
5,815,848 A * 10/1998 Jarvis ..... A42B 3/225 2/424
5,819,311 A * 10/1998 Lo ..... A42B 1/247 2/12
D404,849 S 1/1999 Desy
5,924,129 A * 7/1999 Gill ..... A42B 1/062 2/10
5,991,930 A * 11/1999 Sorrentino ..... A42B 3/22 2/424
D418,256 S 12/1999 Caruana
6,173,447 B1 * 1/2001 Arnold ..... A42B 1/064 2/10
6,237,147 B1 * 5/2001 Brockman ..... A42B 1/247 2/10
6,347,401 B1 * 2/2002 Joyce ..... A61F 9/029 2/15
6,375,865 B1 * 4/2002 Paulson ..... A61F 9/06 2/410
6,378,133 B1 * 4/2002 Daikuzono ..... A61F 9/06 2/15
6,381,750 B1 * 5/2002 Mangan ..... A42B 3/225 2/10
6,385,776 B2 5/2002 Linday
6,491,390 B1 * 12/2002 Provost ..... A42B 1/247 2/10
6,584,614 B2 * 7/2003 Hogg ..... A42B 1/247 2/10
D480,838 S 10/2003 Martin
6,662,371 B2 * 12/2003 Shin ..... A42B 1/247 2/10
6,739,718 B1 * 5/2004 Jung ..... A42B 1/247 2/10
D512,797 S 12/2005 Canavan
D526,446 S * 8/2006 Cowan ..... D29/109
7,097,080 B2 * 8/2006 Cox ..... A42B 1/002 223/14
7,103,920 B1 * 9/2006 Otterson ..... A42B 1/247 2/195.1
D541,991 S * 5/2007 Lawrence ..... D29/110
D559,442 S 1/2008 Regelbrugge
7,344,241 B2 * 3/2008 Baek ..... A42B 1/247 2/10
D569,557 S 5/2008 Cho
D586,052 S * 2/2009 Elias ..... D29/122
7,631,365 B1 * 12/2009 Mahan ..... A42B 3/20 2/6.6
7,937,775 B2 * 5/2011 Manzella, Jr. ..... A41D 13/0025 2/171.3
8,024,818 B1 * 9/2011 Davenport ..... A42B 1/067 2/172
D683,077 S * 5/2013 Klotz ..... D29/110

(56) References Cited

U.S. PATENT DOCUMENTS

| | | | | |
|---|---|---|---|---|
| D692,187 | S | 10/2013 | Isobe | |
| D692,189 | S | 10/2013 | Isobe | |
| D726,378 | S | 4/2015 | Wako | |
| 9,170,415 | B2 * | 10/2015 | Mansuy | A42B 1/247 |
| D759,900 | S * | 6/2016 | Cummings | D29/110 |
| D781,507 | S | 3/2017 | Huh | |
| D781,508 | S | 3/2017 | Huh | |
| 9,629,407 | B2 * | 4/2017 | Foster | A42B 1/18 |
| D815,190 | S | 4/2018 | Dellemann | |
| 10,165,819 | B2 * | 1/2019 | Klotz | A42B 3/225 |
| D849,240 | S | 5/2019 | Guo | |
| D850,256 | S | 6/2019 | Ryszawy | |
| D879,384 | S | 3/2020 | Sato | |
| D882,182 | S | 4/2020 | Fekete | |
| 10,687,569 | B1 * | 6/2020 | McDirmid | A42B 3/20 |
| D907,299 | S * | 1/2021 | Brown, II | D29/110 |
| D907,300 | S * | 1/2021 | Brown, II | D29/110 |
| 2004/0139530 | A1 * | 7/2004 | Yan | A42B 1/241 2/209.13 |
| 2005/0133035 | A1 * | 6/2005 | Yahiaoui | A61F 9/045 128/206.19 |
| 2006/0158609 | A1 * | 7/2006 | Heil | G02C 7/16 351/158 |
| 2009/0119819 | A1 * | 5/2009 | Thompson | A42B 1/062 2/209.13 |
| 2010/0122402 | A1 * | 5/2010 | Tipp | A42B 3/04 2/422 |
| 2010/0146679 | A1 * | 6/2010 | Heil | A42B 1/24 2/9 |
| 2012/0047614 | A1 * | 3/2012 | Choi | A41D 13/1184 2/9 |
| 2012/0180204 | A1 * | 7/2012 | Hawkins | G02B 5/205 2/424 |
| 2012/0291173 | A1 * | 11/2012 | Gleason | A41D 13/1184 2/10 |
| 2013/0145525 | A1 * | 6/2013 | Arenson | A42B 1/061 2/424 |
| 2014/0020153 | A1 * | 1/2014 | Romanski | A42B 1/004 2/206 |
| 2015/0033431 | A1 | 2/2015 | Hofer | |
| 2016/0050990 | A1 * | 2/2016 | Hayes | A42B 1/064 2/9 |
| 2016/0073720 | A1 * | 3/2016 | Niedrich | A42B 1/06 2/173 |
| 2017/0079364 | A1 * | 3/2017 | Paulson | A42B 3/225 |
| 2017/0208878 | A1 * | 7/2017 | Kakinuma | A61F 9/02 |
| 2017/0318877 | A1 * | 11/2017 | Yahiaoui | A41D 13/11 |
| 2018/0042324 | A1 * | 2/2018 | King | A42B 1/062 |
| 2018/0052334 | A1 * | 2/2018 | Repko | G02C 7/10 |
| 2018/0148578 | A1 * | 5/2018 | Ohta | A61F 9/029 |
| 2018/0161208 | A1 * | 6/2018 | Huh | A61F 9/025 |
| 2018/0295925 | A1 * | 10/2018 | Gagliardo | A42B 3/04 |
| 2018/0338550 | A1 * | 11/2018 | Boulware | A41D 13/1161 |
| 2019/0021430 | A1 * | 1/2019 | Elliott | A61F 9/045 |
| 2019/0037948 | A1 * | 2/2019 | Romanski | A41D 13/11 |
| 2019/0209912 | A1 * | 7/2019 | Isserow | A42B 3/08 |
| 2019/0212474 | A1 * | 7/2019 | Le Quang | G02B 1/115 |
| 2020/0100657 | A1 * | 4/2020 | Lee | A61B 1/233 |
| 2020/0178622 | A1 * | 6/2020 | Jascomb | B32B 27/36 |
| 2020/0281301 | A1 * | 9/2020 | Wynalda, Jr. | A42B 3/225 |
| 2021/0030095 | A1 * | 2/2021 | Reicher | A42C 1/06 |

OTHER PUBLICATIONS

Tom Zillich, Surrey manufacturer hopes to hit home run with face shield that clips to baseball cap, Apr. 29, 2020, 3 pages.

Opentip, Opromo Safety Face Shield Visor for Adult Kids,Protective Cotton Hat with Removable PVC Face Cover <https://www.opentip.com/product.php?products_id=11699030>, May 5, 2020, 3 pages.

Hefute, Hefute 5 PCS Protective Face Cover with Shield Comfortable Full Protection Face Compatiable with Glasses Anti-Droplet Anti-Pollution and Windproof Transparent Safety Face Cover with Shield(Style B) <https://www.amazon.com/dp/B086GSG8DH/ref=sspa_dk_detail_9?psc=1&pd_rd_i=B086GSG8DH&pd_rd_w=Ocdm28,pf_rd_p=48d372c1-f7e1-4b8b-9d02-4bd86f5158c5&pd_rd_wg=qkB2b&pf_rd_r=M%E2%80%A6>, May 6, 2020, 7 pages.

Geanbaye, Geanbaye Safety Full Face Shield Cap Detachable Baseball Cap Anti-Saliva Anti-Spitting Eye Protective Hat Windproof Dustproof <https://www.amazon.com/dp/B086DV32B8/ref=sspa_dk_detail_87 psc=1&pd_rd_i=B086DV32B8&pd_rd_w=MwjfT&pf rd_p=48d372c1-f7e1-4b8b-9d02-4bd86f5158c5&pd_rd_wg=pxuOs&pf rd_r=PNDA%E2%80%A6>, May 5, 2020, 8 pages.

Leigh Buchanan, These 2 Companies Are Making Face Shields for Everyone <https://www.inc.com/leigh-buchanan/face-shields-coronavirus-protection-open-source.html>, May 6, 2020, 8 pages.

Brim Shield, photographs, Apr. 21, 2020, 1 pages.

Hatshield, Shield Yourself With the Hatshield <https://www.hatshield.com/?gclid=CjwKCAjwp-X0BRAFEiwAheRui1u89v_3URuiwEVvBRGa9TaEFWoVMJXRkWsZgPTUw-0fHJ5HD-8uhoCc84QAvD_BwE>, Apr. 17, 2020, 11 pages.

Eli N. Perencevich, Moving Personal Protective Equipment Into the Community Face Shields and Containment of COVID-19, Apr. 19, 2020, 2 pages.

Patent Cooperation Treaty, International Search Report and Written Opinion for International Application No. PCT/US2021/026165, dated Jul. 9, 2021, 10 pages.

* cited by examiner

PROTECTIVE FACE SHIELD ATTACHABLE TO HEADWEAR

CROSS-REFERENCE TO RELATED APPLICATIONS

This application claims the benefit of U.S. Design Application No. 29/733,809 filed May 6, 2020 and U.S. Provisional Application No. 63/011,864 filed Apr. 17, 2020, the contents of both of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to a protective face shield, and more specifically, to a protective face shield connectable to a headwear of a user.

2. Description of the Related Art

It is known that communicable disease can be transferred from one person to another. Indeed, certain viruses and bacteria can become airborne when an infected individual sneezes or coughs. Those airborne particles, which may include virus or bacteria droplets, may be inhaled by another individual, thereby infecting the individual. The virus and bacteria may also fall onto a surface, which may be subsequently touched by an individual. Should that individual touch his mouth, nose, or eyes, the virus or bacteria may pass to that individual.

The COVID-19 pandemic resulted in many jurisdictions issuing restrictions or stay-at-home orders to combat the spread of the highly infectious disease. While staying at home may provide protection for those individuals who have the ability to stay home, health care workers are needed on the front lines to combat the disease, and thus, may have an elevated degree of exposure to the disease. Accordingly, the use of adequate personal protective equipment (PPE), such as face masks, face shields, face coverings, gowns and gloves are critical in ensuring the safety of the healthcare professionals, while also mitigating the spread of the disease.

While PPE is critical to healthcare workers treating patients with the disease, there is also a desire to ease stay-at-home restrictions in a safe and calculated manner. It has been recommended that in order to ease such restrictions, the use of masks and face shields may be adopted to certain degrees on a society-wide level. See *Moving Personal Protective Equipment Into the Community*, Eli Perencevich, Daniel Diekema, Michael Edmond, JAMA, Apr. 29, 2020. For instance, states, airlines, retail stores, or other commercial or public establishments may mandate face masks or "face coverings" as they reopen.

Commonly used face masks include N95 masks, which may filter approximately 95% of airborne contaminants, and cloth face masks, which may filter approximately 2% of airborne contaminants. Although such masks may provide a certain level of protection to a user, face shields may be more effective is protecting the wearer and slowing the spread of communicable disease. Face shields generally extend over the eyes, nose and mouth of the wearer, and thus, typically provide a greater amount of coverage when compared to conventional medical masks. Furthermore, face masks may be limited in their durability and lifespan, whereas face shields may be reused indefinitely and can be easily cleaned with common household disinfectants. Face shields are also preferable to the typical face mask because the configuration of face shields may reduce the likelihood of potential autoinoculation by preventing the wearer from touching their face.

Accordingly, there is a need in the art for an improved face shield that which can be easily and comfortably worn to mitigate the spread of contaminants. Various aspects of the present disclosure address this particular need, as will be discussed in more detail below.

BRIEF SUMMARY

In accordance with one embodiment of the present disclosure, there is provided a low-cost, unitary, protective shield for use with headwear having a brim and wearable by a user, the protective shield comprising a panel having an elongate slot formed therein and sized to receive the brim of the headwear to facilitate attachment of the protective shield to the headwear. The panel additionally includes an upper suspension strap portion and a lower protective portion configured to extend over the user's eyes, nose, and mouth when the protective shield is attached to the headwear. The lower protective portion and the upper suspension strap portion are on opposite sides of the elongate slot. The panel additionally includes at least one lateral tab engageable with the headwear.

The at least one tab may include an adhesive thereon to facilitate engagement with the headwear.

The suspension strap portion may include an upper edge and an opposing lower edge to define a strap height therebetween, the strap height may preferably be between 0.20 inches and 0.40 inches.

The panel may have a haze level that is preferably less than 2%.

The protective shield may additionally include a layer of silver disposed on the panel.

The upper suspension strap portion may include a lower edge and the lower protective portion may include an upper edge. A slot height may be defined as a distance between the lower edge and the upper edge, with the slot height preferably being between 0.05 inches-0.13 inches.

The elongate slot may be sized to include a region that extends below the brim when the brim is received within the elongate slot, such that the region facilitates ventilation to permit air flow across the back surface of the lower protective portion to reduce fogging caused by user breath exhalation.

The lower protective portion or the upper suspension strap portion may include friction elements extending into the elongate slot to facilitate frictional engagement with the brim when the brim is inserted into the elongate slot.

The upper suspension strap portion and the lower protective portion may be configured such that a lower edge of the suspension strap portion may contact an upper edge of the protective portion when the brim is removed from the elongate slot, and the lower edge of the upper suspension strap portion may be spaced from the upper edge of the lower protective portion when the brim is received within the elongate slot.

The protective shield may additionally include a centering notch formed on the upper suspension strap portion.

According to another embodiment, there is provided a protective shield for use with headwear having a brim. The protective shield includes a unitary panel having a slot, an upper region, a lower region, and at least one lateral tab. The upper region and the lower region are separated by the slot, with the slot being sized to receive the brim of the headwear. The upper and lower regions are positioned on opposite sides of the brim when the brim is received within the slot. The lower region is sized to extend over the eyes, nose and mouth of a user when the brim is received in the slot and the headwear is worn on the user's head. The at least one tab is engageable with the headwear.

The protective shield may include a peripheral frame coupled to the unitary panel adjacent a peripheral edge thereof. The peripheral frame may be bendable and configured to assume a desired configuration.

According to another embodiment, there is provided a method of forming a protective shield for use in combination with headwear having a brim. The method includes the step of cutting a sheet of an optically clear material to form a unitary panel having a slot, an upper region, a lower region, and at least one lateral tab.

The method may include the step of printing a band adjacent at least a portion of a peripheral edge of the unitary panel.

According to another embodiment, there is provided a method of wearing a protective shield in combination with headwear having a brim. The method includes aligning the protective shield with the brim. The protective shield includes a panel having an elongate slot formed therein and sized to receive the brim of the headwear to facilitate attachment of the protective shield to the headwear. The panel additionally includes an upper suspension strap portion and a lower protective portion configured to extend over the user's eyes, nose, and mouth when the protective shield is attached to the headwear. The lower protective portion and the upper suspension strap portion are on opposite sides of the elongate slot. The panel additionally includes at least one lateral tab engageable with the headwear. The method further includes inserting the brim through the slot to connect the headwear to the protective shield.

The method may also include the step of adhering the at least one tab to the headwear.

The method may further include the step of adjusting a position of the protective shield along the brim.

The method may additionally include removing the headwear from the user's head without touching the protective shield.

The protective shield may transition from a generally planar configuration to a generally arcuate configuration in response to the brim being inserted through the slot.

According to another embodiment, there is provided a method of connecting a protective shield to headwear having a brim and a main head portion. The method includes aligning the protective shield with the brim. The protective shield includes a panel having an elongate slot formed therein and sized to receive the brim of the headwear to facilitate attachment of the protective shield to the headwear. The panel additionally includes an upper suspension strap portion and a lower protective portion configured to extend over the user's eyes, nose, and mouth when the protective shield is attached to the headwear. The lower protective portion and the upper suspension strap portion are on opposite sides of the elongate slot. The panel additionally includes at least one lateral tab engageable with the headwear. The method also includes positioning the protective shield in close proximity to the main head portion of the headwear such that the protective panel is positioned relative to the user's eyes to urge the user to view through the protective panel and focus on an object beyond the panel and mitigate the user from focusing directly on the protective panel.

The method may also include the step of engaging the at least one lateral tab to the headwear to fix the position of the protective shield relative to the headwear.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
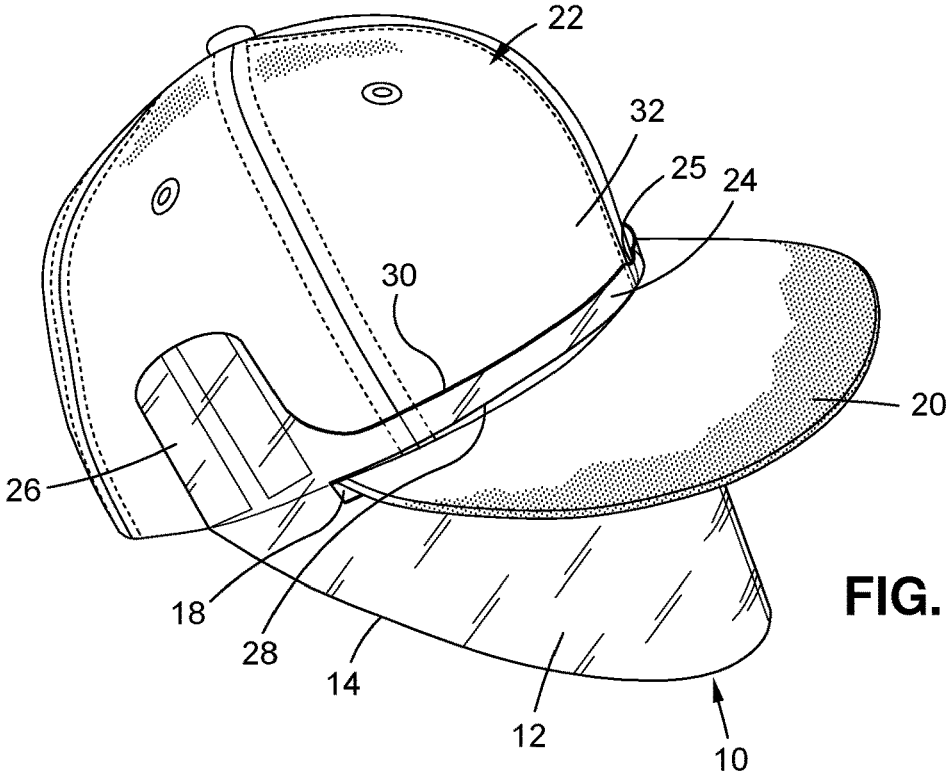
FIG. 1 is an upper perspective view of a protective face shield connected to a brim of a cap.
Figure 2:
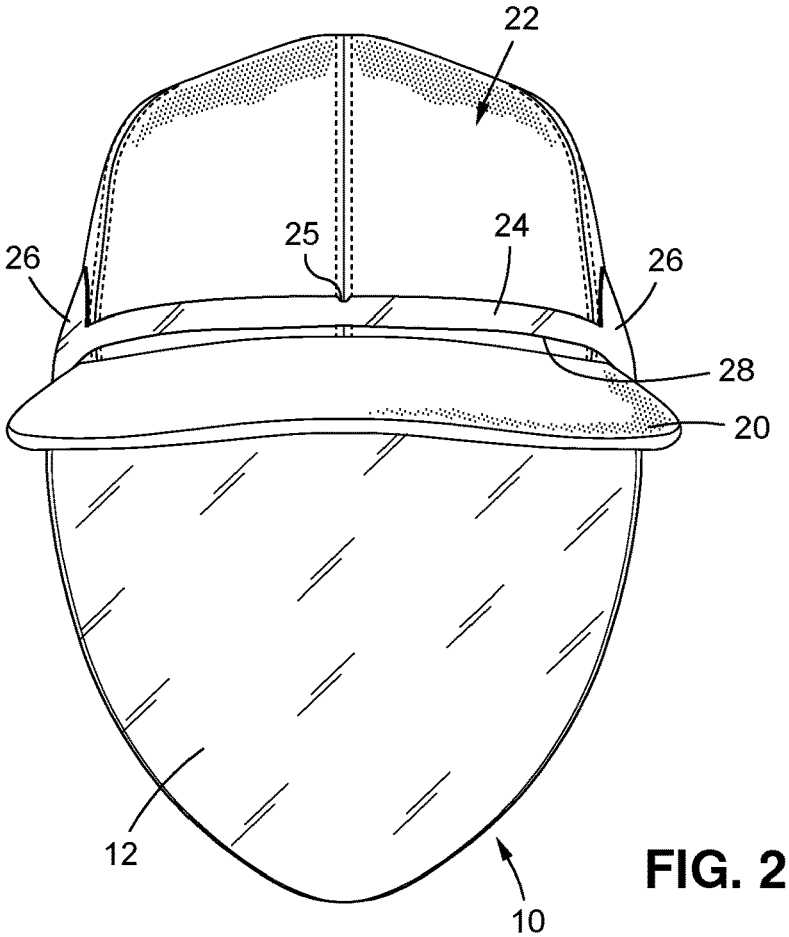
FIG. 2 is a front view of the protective face shield and cap of FIG. 1.
Figure 3:
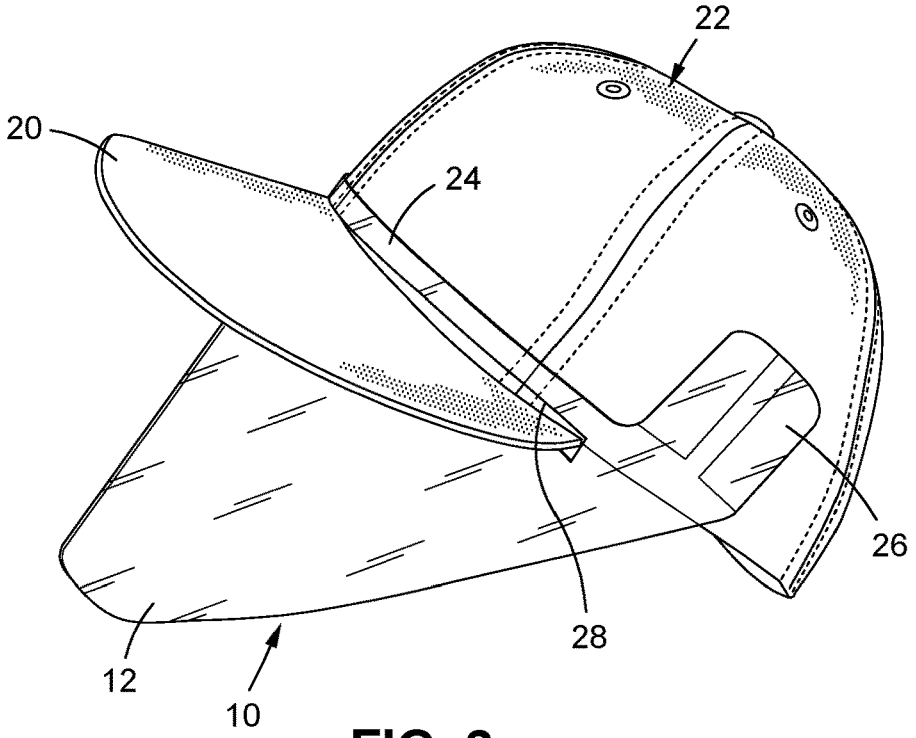
FIG. 3 is a side view of the protective face shield and cap of FIG. 1.
Figure 4:
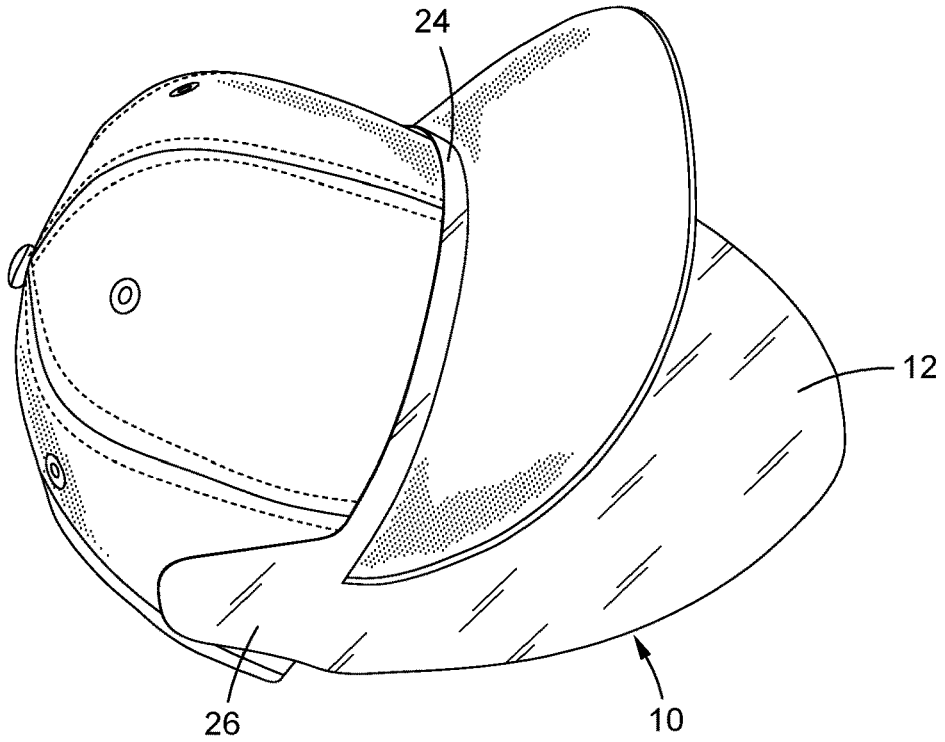
FIG. 4 is another upper perspective view of the protective face shield attached to a cap.
Figure 5:
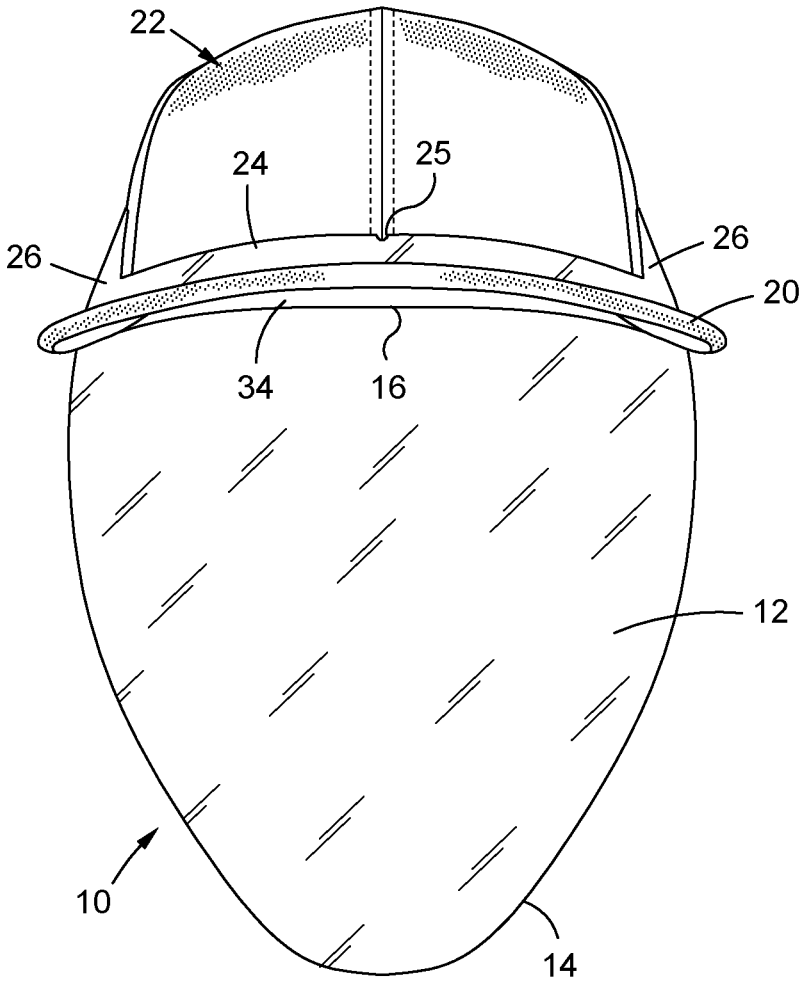
FIG. 5 is a front view of the protective face shield attached to the cap, and illustrating a ventilation opening formed by the brim and the protective face shield, with the opening being underneath the brim to facilitate ventilation.

The detailed description set forth below in connection with the appended drawings is intended as a description of certain embodiments of a protective face shield and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings wherein the showings are for purposes of illustrating preferred embodiments of the present disclosure, and are not for purposes of limiting the same, there is depicted a protective face shield, i.e., face covering, specifically configured and adapted to be attached to and supported upon a cap or other headgear worn by a user. When attached to the cap, the protective face shield may extend over a wearer's face to provide protection against contaminants, airborne droplets, particles, dust, debris, or the like. The face shield may include a transparent panel that provides protection to the wearer, but also allows a wearer to look therethrough without substantially inhibiting the wearer's vision. In this regard, the face shield may be mounted on the cap or headgear such that the face shield is positioned in close proximity to the user's eyes to allow the user to easily view through the face shield and focus on an object beyond the face shield, rather than focusing on the face shield itself. The face shield may also include one or more tabs that may be connected to the headgear to prevent inadvertent slippage or movement of the face shield relative to the headwear once the face shield is in a desired position relative to the headgear.

Referring now specifically to FIGS. 1-5, there is provided a first embodiment of a protective face shield 10 wearable by a user. The face shield 10 may be formed from a unitary panel that may be cut, or otherwise formed, to define a particular configuration and have certain features to facilitate connection of the face shield 10 to headgear and to provide a protective layer over the wearer's face. The face shield 10 may include a transparent protective portion 12 sized and configured to extend over a wearer's face. The transparent protective portion 12 is optically clear, and thus, may have very little or no perceptible visible distortion or scatter when viewed through by the user. An optically clear material may be transparent and/or colorless, but in some circumstances, a material that has a hue, shade, or a tint, for example, can be considered optically clear. It is also contemplated that in some embodiments, the optically clear material may include a heat-rejection coating applied thereto.

The protective portion 12 may include a curved, arcuate, or tapered outer peripheral edge 14 that is wider at the top of the protective portion 12, and narrower at the bottom of the protective portion 12. The tapered peripheral contour of the protective portion 12 may allow for freedom of movement of the user's head without the protective portion 12 adversely contacting the user's body. In particular, the tapered peripheral contour may allow a user to turn the user's head from side-to-side without the protective portion 12 contacting the user's shoulders. Furthermore, the tapered peripheral contour may also allow a user to tip the user's head downwardly without the protective panel contacting the user's chest. The tapered configuration may also allow for cross-air flow between the face shield 10 and the user for easier breathing and to providing cooling to the user. The protective portion 12 may additionally include an upper edge 16, which partially defines a slot 18 sized to receive a brim 20 of a cap 22, as will be described in more detail below.

The protective portion 12 may have a thickness (e.g., a distance between an inner surface and an outer surface) of preferably 5-30 mil, more preferably 7-20 mil, still more preferably 10-15 mil, and every more preferably 15 mil, although other thicknesses may be used without departing from the spirit and scope of the present disclosure. In this regard, the thickness of the protective portion 12 may be thick enough to have desired stiffness and rigidity, while keeping the haze preferably below 2%. The preferred thickness of 15 mil may provide desired optical qualities (e.g., low haze, high visible transmission, ideal color, i.e., non-yellow, and uniform thickness), rigidity and stiffness, tensile strength. The 15 mil preferred thickness may also result in a panel that is lightweight, formable, printable, capable of roll to roll converting, capable of rotary die converting, capable of roll to roll flexographic printing, and provides UVA/UVB protection.

The protective portion 12 may be formed from a polycarbonate film, such as LEXAN™ 8010, or an optical polyethylene terephthalate (PET) material, thermoplastic polyurethane (TPU), polyphenylsulfone (PPSU), acrylic (e.g., plexiglass), PETA (grade of polyester) or PETG (grade of polyester), although other materials known in the art may also be used.

The protective portion 12 is sized and configured to extend over a user's face, and in particular, the mouth, nose, and eyes of the user's face to protect the user's face from a contaminant, such as a virus or bacteria. For instance, the protective face shield 10 may be used in a medical capacity, and thus, the protective portion 12 may be sized to protect a medical professional from potential contaminants associated with a sneeze or cough of a potentially infected patient.

Figure 6:
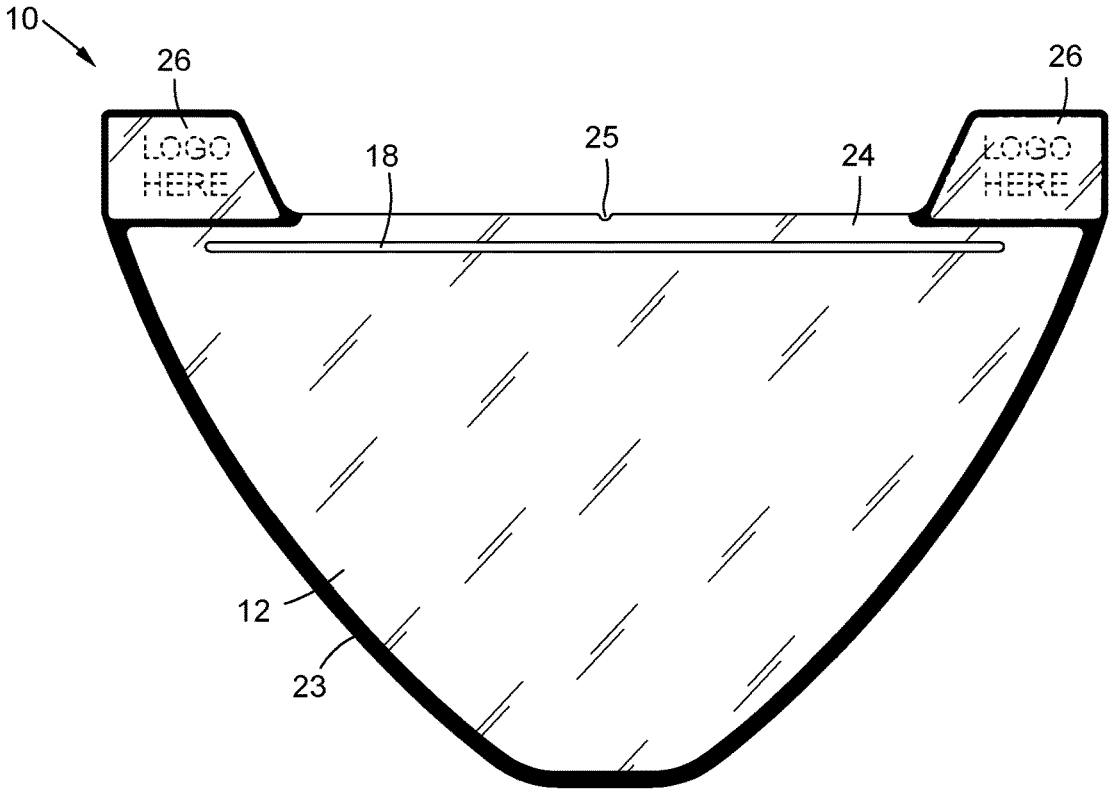
FIG. 6 is a front view of an uninstalled protective face shield having a darkened peripheral edge region.
Figure 7:
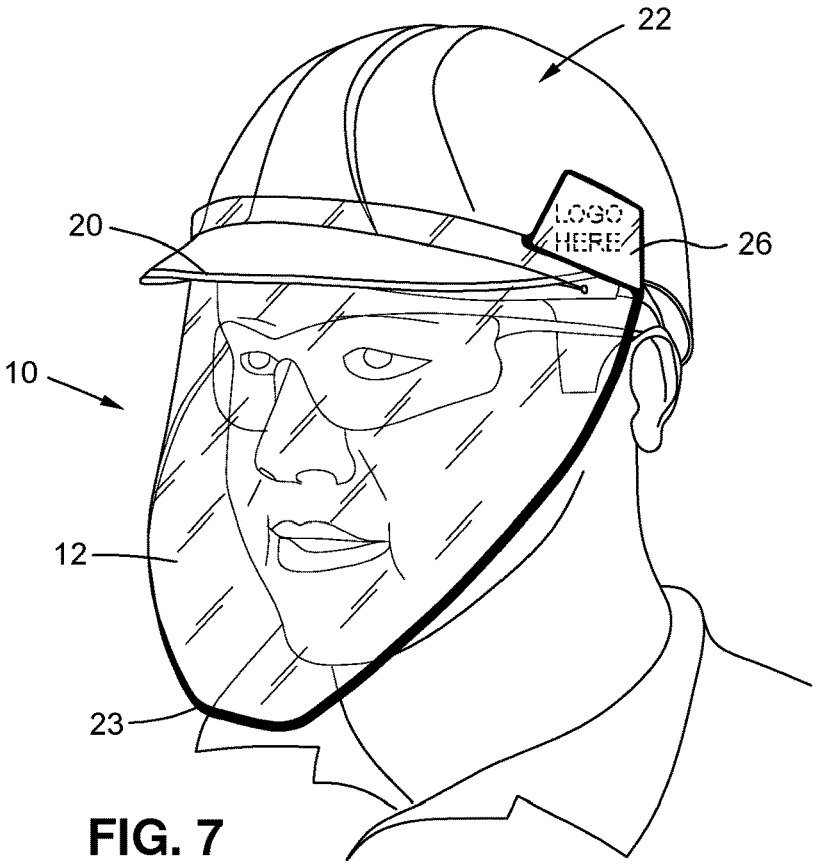
FIG. 7 is an upper perspective view of the face shield of FIG. 6 installed on a hat worn by a user.

Referring now to FIGS. 6-7, the protective portion 12 may include a peripheral edge region 23 that may be printed or coated to provide a contrast with the central region of the protective portion. The printing or coating may be black, or other any other color, and extend adjacent or along the peripheral edge. It is also contemplated that the peripheral edge region 23 may be printed or coated with a reflective material or include a reflective tape for use of the protective face shield 10 at night, such for use in construction or security at night.

In one embodiment, the protective portion 12 may be formed from, or include, an antimicrobial film or configuration which prevents transmission of bacteria or other contaminants therethrough. The antimicrobial configuration may include a layer or laminate of a silver material, such as silver oxide. It is also contemplated that the outer surface of each layer may have a surface configuration that prevents micro-organisms from attaching thereto. It is also contemplated that the protective portion 12 may have a UV additive applied thereto to protect against UV light. The inner surface of the protective portion 12 may additionally be coated with an anti-fogging substance to mitigate fogging resulting from the user's breath during use.

Although the exemplary embodiment includes a protective portion 12 that is a single layer, it is contemplated that other embodiments of the face shield 10 may include a stack of layers, with at least one peeleable layer that may be peeled away from an underlying layer when contaminated. For more information regarding an example of the peelable layers and the adhesive used to interconnect the layers, please refer to U.S. Pat. No. 10,321,731 entitled Adhesive Mountable Stack of Removable Layers, as well as U.S. Pat. No. 6,388,813 entitled Optical Stack of Laminated Removable Lenses for Face Shields Windows and Displays, the contents of both of which are expressly incorporated herein by reference.

The face shield 10 may be used with a user's existing headwear, including a baseball-style cap, a construction hat, a visor, or other headwear known in the art. Along these lines, the face shield 10 includes several features which facilitate engagement with a cap 22. In the exemplary embodiment, the face shield 10 includes a suspension strap portion 24, and at least one attachment tab 26. The suspension strap portion 24 is an elongate structure connected to the protective portion 12 at peripheral side portions of the face shield 10, and which is configured to extend above the brim 20 of the cap 22 during use. In this regard, the suspension strap portion 24 may be of sufficient strength to support the weight of the face shield 10 on the cap 22. The suspension strap portion 24 includes a lower edge 28 that is opposite the upper edge 16 of the protective portion 12. The suspension strap portion 24 additionally includes an upper edge 30 such that a strap thickness is defined as the distance between the lower and upper edges 28, 30 of the suspension strap portion 24. The strap thickness may preferably be between ¼"-⅜", which may be thin enough to conform to differences in cap configuration. The suspension strap portion 24 may optionally include a centering notch 25 or other indicia or marking that indicates a center of the suspension strap portion 24. The centering notch 25 may be located equidistantly between the attachment tabs 26 and may be used to facilitate centering of the protective face shield 10 on the headwear. Along these lines, the headwear may include a seam or other marking that may be representative of the center of the headwear, and which may be visually aligned with the centering notch 25 which placing the protective face shield 10 on the headwear.

The exemplary embodiment includes a pair attachment tabs 26 may positioned on opposite sides of the suspension strap portion 24, such that the suspension strap portion 24 extends longitudinally between the attachment tabs 26. The attachment tabs 26 include an enlarged body that is easily grabbable and manipulatable by a user. In this regard, the attachment tabs 26 may extend upwardly beyond the suspension strap portion 24 to provide a larger structure with which a user may manipulate or handle. The inner surface of each attachment tab 26 may be coated with an adhesive to facilitate engagement of the attachment tab 26 to an outer surface of the cap or headgear 22. In this regard, the tabs 26 may allow the user to conform the face shield 10 to the configuration or contour of the particular hat to which shield 10 is being attached. Thus, the tabs 26 assist in allow the face shield 10 to be a universal face shield (e.g., usable with different hats or headgear). Although the foregoing describes adhering the tabs 26 to the headgear 22, it is contemplated that double sided tape, hook and loop fasteners (e.g., VELCRO™), or other releasable fastening systems known in the art may be used to connect the attachment tab 26 to the cap or headgear 22. Although the exemplary embodiment shows the attachment tabs 26 engageable with the outside of the cap 22, it is also contemplated that the attachment tabs 26 may extend inside the cap 22. Furthermore, it is also contemplated that the tabs 26 may be insertable into a slot formed in the headgear 22. In this regard, many forms of headgear include an internal band or layer that is connected to an outer layer of the headgear 22. One or more slots may be formed between the internal band and the outer layer to receive the tabs 26. Furthermore, although the exemplary embodiment includes a pair of attachment tabs 26, it is contemplated that other embodiments may include only one attachment tab 26, or more than one pair of attachment tabs 26.

Figure 8:
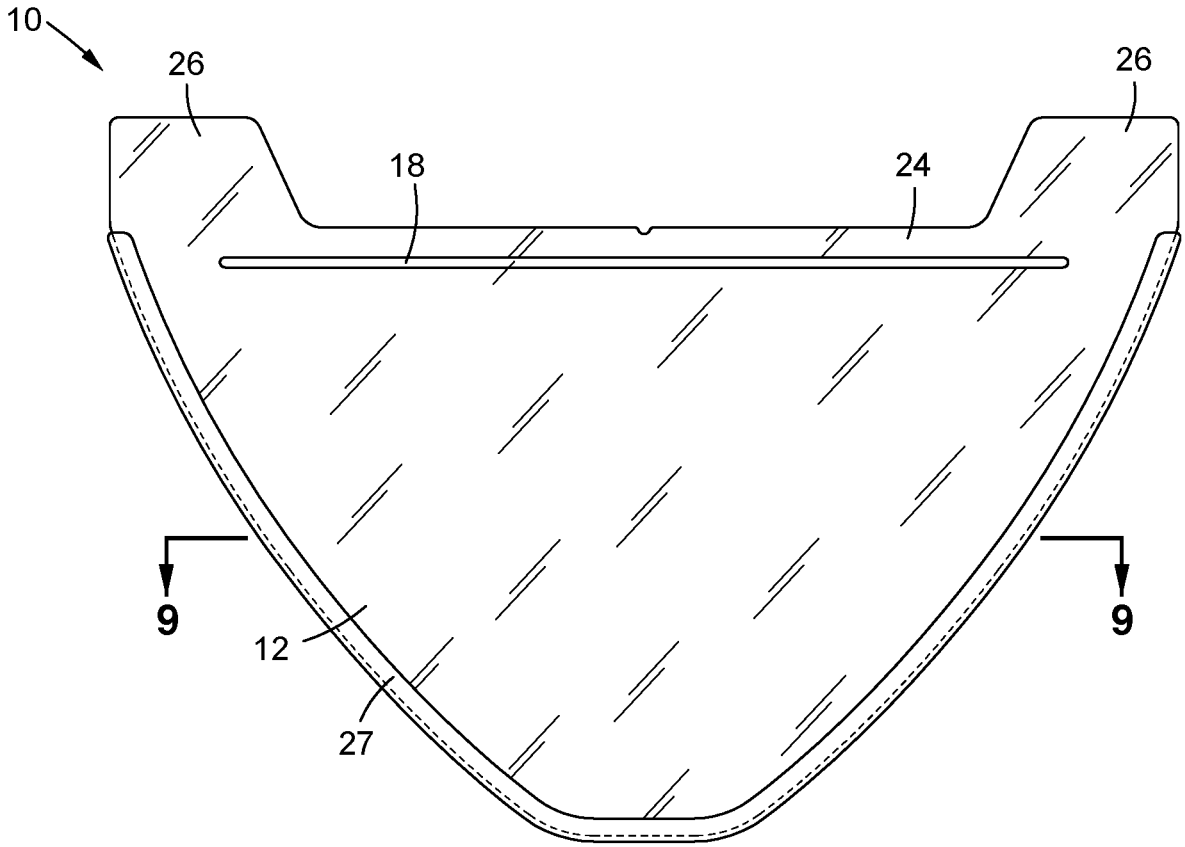
FIG. 8 is a front view of a protective face shield having a peripheral frame attached to a main panel.
Figure 9:
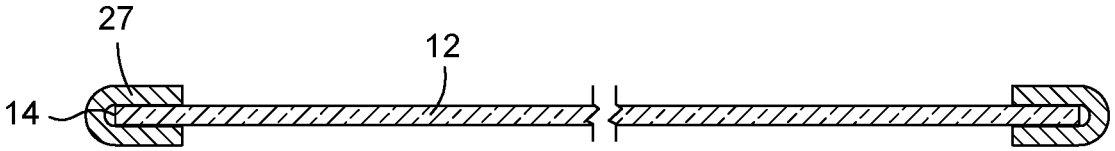
FIG. 9 is a cross sectional view of the protective face shield of FIG. 8.
Figure 10:
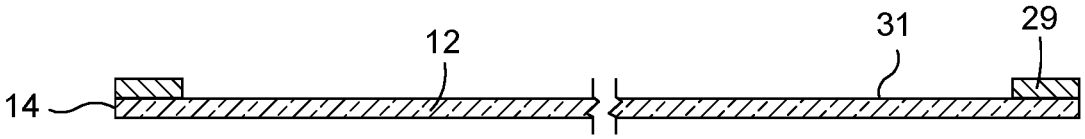
FIG. 10 is a cross sectional view of a protective face shield having a laminated foil adjacent a peripheral edge of a main panel.

Referring now to FIGS. 8-10, it is contemplated that the face shield 10 may include a peripheral frame attachable the protective portion adjacent a peripheral edge thereof to add stiffness to the face shield and to allow the user to adjust the curvature of the face shield 10 to conform to the user's face. In FIGS. 8-9, peripheral frame 27 is shown including a body having a u-shaped cross section is placed along the peripheral edge 14 of the protective portion 12. The body may be adhered or crimped onto the protective portion 12. The body may be bendable or flexible but does not spring back to its original shape when bent. As such, the user can bend the peripheral frame 27 into the desired curvature and the peripheral frame 27 will retain that curvature.

FIG. 10 shows another embodiment of a peripheral frame 29 that includes a laminated foil laminated to an outer surface 31 of the protective portion 12 of the face shield 10 adjacent the peripheral edge 14. The laminated foil may be bendable or flexible but does not spring back to its original shape when bent, and thus, may be used to attain a desired curvature of the protective shield 10.

To connect the face shield 10 to the cap 22, the brim 20 of the cap 22 is aligned with the slot 18, and then advanced through the slot 18. As the face shield 10 is moved onto the cap 22, the face shield 10 may transition from a generally planar configuration to an arcuate configuration to conform to the rounded or arcuate configuration of the cap 22. The face shield 10 may be moved from the front of the brim 20 toward the back of the brim 20 and the main crown portion 32 of the cap 22 (e.g., that portion of the cap 22 coupled to the brim 20). It is understood that the main crown portion 32 need not cover the entirety of the user's head, such as a visor. The exact position of the face shield 10 may be selectively adjusted in a front-to-rear direction in order to provide the most comfortable fit and view for the user. In this regard, it is contemplated that the face shield 10 may be moved in close proximity to the back of the brim 20 such that the suspension strap portion 24 contacts the main crown portion 32 of the cap 22. The suspension strap portion 24 may be flexible and capable of conforming to, or assuming, the curved or arcuate configuration of the cap 22 in response to contact with the cap 22. The suspension strap portion 24 may optionally include double sided tape connected thereto to facilitate adhering of the suspension strap portion 24 to the main crown portion 32 of the cap 22.

The arcuate configuration of the face shield 10 when attached to the cap 22 may be such that there are no folds or creases in the face shield 10, particularly within the protective portion 12, that may otherwise create visual distortions to the wearer. In this regard, the arcuate configuration or curvature of the face shield 10 may form an optically correct radius around the wearer's eyes and face.

When the protective portion 12 is positioned in close proximity to the main crown portion 32 of the cap 22 and in close proximity to the user's eyes, the user's eyes may be able to more naturally, and easily view through the protective portion 12 and focus on an object beyond the protective portion 12, rather than focusing directly on the protective portion 12. In this regard, it is understood that if the protective portion 12 were located at the free end of the brim 20 and not in close proximity to the user's eyes, there would be a tendency for the user to focus on the protective portion 12, rather than focusing on something beyond the protective portion 12. However, when the protective portion 12 is moved closer to the user's eyes, the user is more likely to naturally view through the protective portion 12 and focus on an object beyond the protective portion 12.

Another factor which may impact the positioning of the protective portion 12 may include the contours of the user's face (e.g., the user's nose), as well as any additional gear that may be worn by the user, such as eyeglasses or masks. In this regard, the protective portion 12 may be positioned such that no portion of the user's face or anything worn by the user may not contact the protective portion 12. Furthermore, it is contemplated that the angle of the protective portion 12 may be positioned such that the lower end of the protection portion 12 is titled away from the nose and mouth of the user to mitigate fogging of the protective portion 12. In this regard, by tilting the protective portion, the user's breath may be more easily vented from behind the protective portion 12 so as to reduce the likelihood of fogging.

When the face shield 10 is in the desired position relative to the cap 22, the attachment tabs 26 may be pressed against the cap 22 to adhere the tabs 26 to the cap 22 and secure the face shield 10 to the cap 22. The combination of the suspension strap portion 24 and the attachment tabs 26 may be sufficient to secure the face shield 10 to the cap 22, and thus, additional fasteners may not be required. When the face shield 10 is attached to the cap 22, the face shield 10 may extend downwardly and side-to-side over the user's eyes, nose and mouth without any creases or perforations in the protective portion 12, which may otherwise be visually distracting to the user.

The ability to attach the face shield 10 to the cap 22 via both the brim 20 and the tabs 26 provides a secure attachment between the face shield 10 and the cap 22. In this regard, the advancement of the brim 20 through the slot 18 allows for selective front-to-back placement of the face shield 10 along the brim 20. The connection of the attachment tabs 26 to the cap 22 may fix the position and angular orientation of the face shield 10 relative to the cap 22 to optimize mobility of the user's head while wearing the cap 22, enhancing ventilation and airflow, while maintaining a sanitary barrier over the user's eyes, nose and mouth.

When the face shield 10 is connected to the cap 22, the protective portion 12 may be configured such that the upper edge 16 of the protective portion 12 is spaced from the brim 20 to form an air gap 34 between the brim 20 and the protective portion 12. The air gap 34 may be sized and located to allow for a chimney effect which induces airflow on the inside of the protective portion 12 to mitigate fogging of the protective portion 12.

When the face shield 10 is attached to the cap 22, the brim 20 of the cap 22 can maintain its original functionality of providing a surface upon which a user may grab to place the cap 22 on or off the user's head. In this regard, the face shield 10 may stay on the cap 22 during successive use of the cap 22 by the user. As such, the face shield 10 may remain in position on the cap 22 during periods of nonuse and may not require subsequent repositioning during reuse.

The configuration of the face shield 10 may not interfere or obstruct logos, indicia or other ornamentation on the cap 22. In this regard, the suspension strap portion 24 may be thin enough to extend under a logo which may be located on the front of the cap 22.

Figure 11:
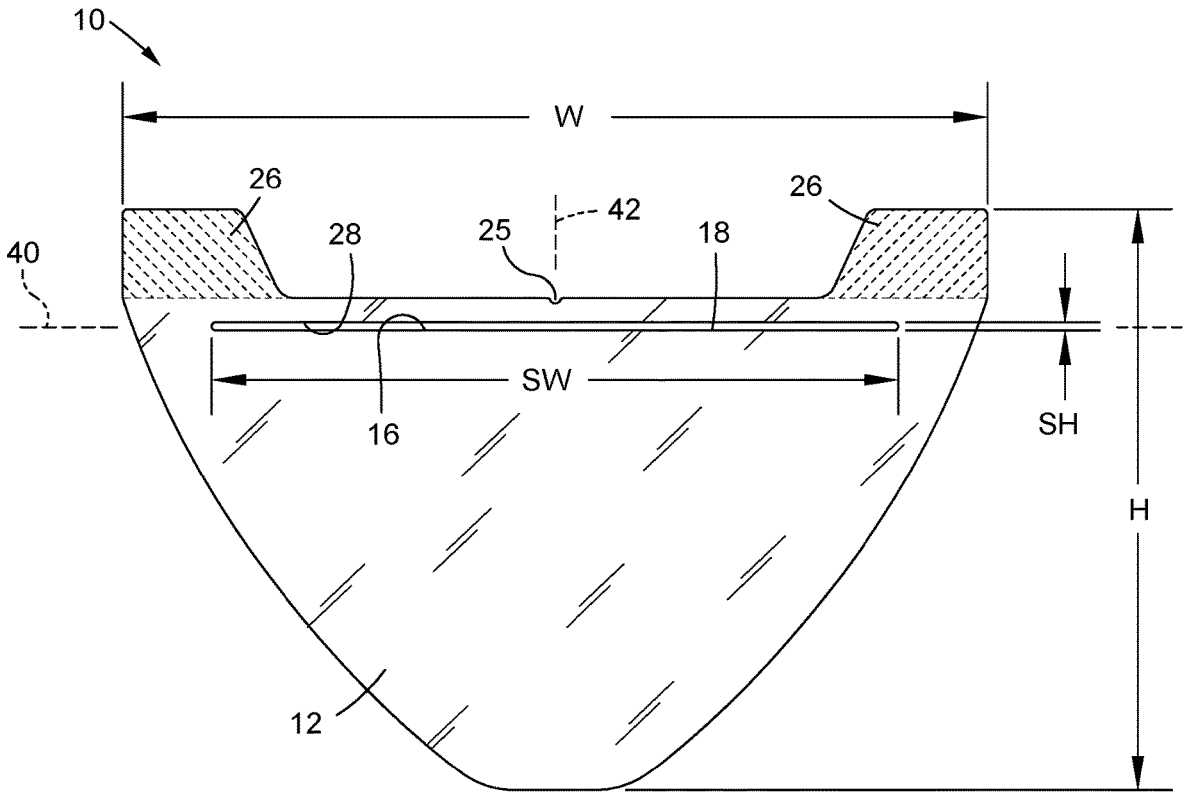
FIG. 11 is a plan view of the protective face shield.

The face shield 10 may be formed from a single, unitary panel of material which may be die-cut. FIG. 11 depicts an exemplary face shield 10 in a flat configuration and having several dimensions labeled thereon. The face shield 10 defines a width, W, as the distance between the lateral edges of the attachment tabs 26. The width W may preferably be between 10-16 inches, and more preferably 13.375 inches. The face shield 10 may also define a height, H, as the distance between a top surface of an attachment tab 26 and the bottom-most edge, or the tangent to the bottom-most portion, of the protective portion 12. As can be seen in FIG. 11, the top surface of the attachment tab 26 (e.g., an upper tab edge) may be offset from an upper edge of the main portion of the panel. A side edge of the attachment tab 26 may extend from the upper edge of the main portion of the panel in non-parallel relation to the upper edge of the main portion of the panel. As depicted in FIG. 11, the slot 18 is of a linear configuration. The face shield 10 shown in FIG. 11 also includes dimensions associated with the slot 18, particularly a slot width, SW, and a slot height, SH. The slot width SW is defined as the distance the slot 18 extends longitudinally, which may be along an axis 40 generally perpendicular to a vertical axis of symmetry 42. The slot height SH may be defined as the distance between the lower edge 28 of the suspension strap portion 24, and the upper edge 16 of the protective portion 12. The slot width SW may vary between preferably 7.5-12.5 inches, and is more preferably 9.875 inches. The slot height SH may preferably be between 0.05 inches-0.15 inches, and more preferably between 0.62 inches-0.125 inches. It is understood that the dimensions and configuration of face shield 10 provided above and shown in FIG. 11 are provided as examples, and are not intended to limit the scope of the present disclosure. Furthermore, although the exemplary face shield 10 is formed from a single, unitary panel, it is contemplated that in other embodiments, the various portions of the face shield 10, e.g., the protective portion 12, the suspension strap portion 24, and the attachment tab(s) 26 may be separate components that are joined together.

It is contemplated that the material used to form the face shield 10 may be configured to allow for printing on the material. As such, various logos, names, identifiers, indicia, or other ornamentation may be imprinted on the face shield 10. For instance, the logo of a sports team may be printed on the face shield 10.

The ease of use provided by the face shield 10 may result in deployment of the face shield 10 in a variety of different applications. For instance, the face shield 10 may be handed out to participants of a large gathering to protect against transmission of possible illness or disease. It is also contemplated that the face shield 10 may be used in the food industry by those handling food to protect against transmission of contaminants into the food.

Referring now to FIGS. 12-15, alternative configurations of the slot 18 formed into the protective face shield 10 are shown. The remaining components of the protective face shield 10, e.g., the attachment tabs 26, and the general configuration of the suspension strap portion 24 and protective portion 12 may remain the same, and thus, the following discussion will be focused on the unique configurations of the slots 18 shown in FIGS. 7 and 8.

Figure 12:
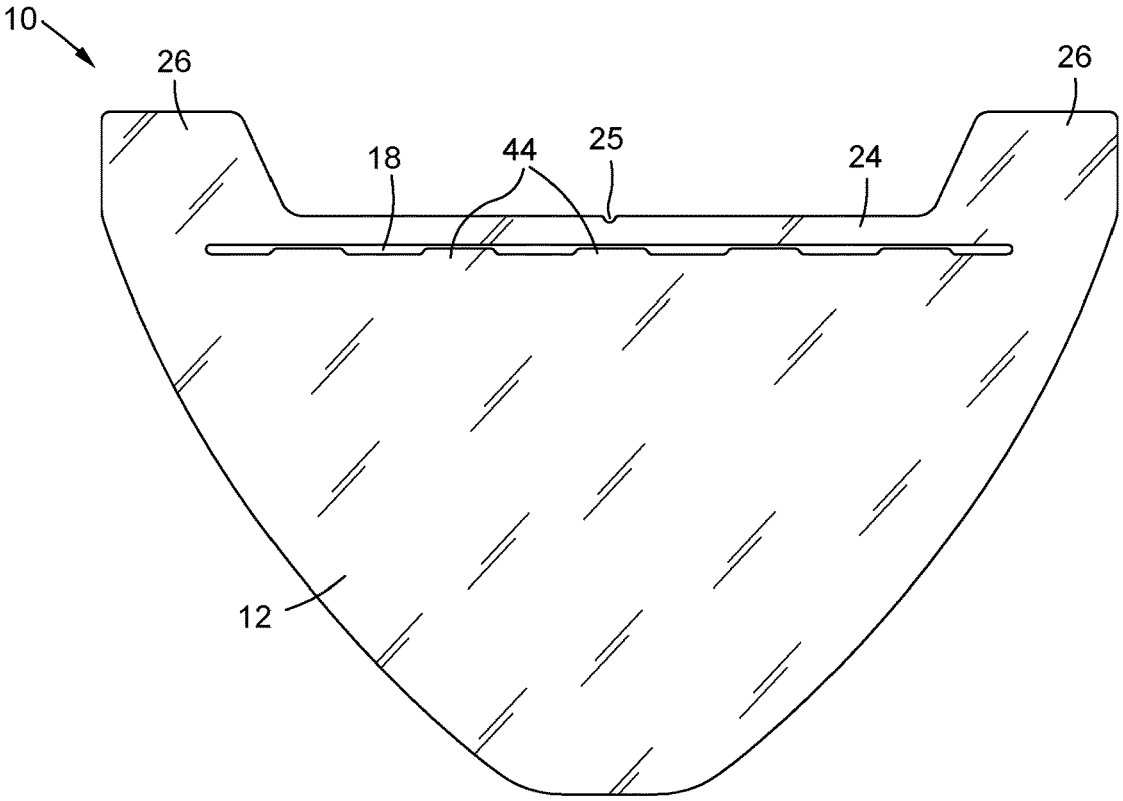
FIG. 12 is a front view of another embodiment of a protective face shield having friction elements extending into a brim-receiving slot.

In FIG. 12, the slot 18 is at least partially defined by a plurality of friction elements 44 (e.g., gripping portions) or teeth that extend upwardly into the slot 18 from the protective portion 12. The configuration of the friction elements 44 results in a slot height SH that varies along the slot 18. In particular, the slot height SH at each friction element 44 is smaller than the slot height SH at the areas of the slot 18 without the friction element 44, e.g., the gaps in the slot 18. The friction elements 44 are sized and configured to increase the friction between the protective face shield 10 and the brim 20 of the cap or headgear 22 when the brim 20 is advanced through the slot 18. When the brim 20 is inserted into the slot 18, the friction elements 44 contact the lower side of the brim 20 and bend in the direction the brim 20 moves through the slot 18, toward the front of the brim 20.

The bent friction elements 44 require a stronger force to remove the brim 20 from the slot 18, thereby enhancing the engagement between the protective face shield 10 and the brim 20. Thus, when initially placing the protective face shield 10 on the brim 20, a user can move the protective face shield 10 on the brim 20 to a desired position, and the protective face shield 10 may remain anchored in that position, even if the cap or headgear 22 is repeatedly taken off, or placed on the user. It is also contemplated that the force between the friction elements 44 and the brim 20 will keep the protective face shield 10 in a desired position upon the cap if the cap is taken off, stored by the user, and then placed back on the head of the user for successive reuse.

The friction elements 44 may be spaced from each other such that the slot height SH may be larger in the area extending between adjacent friction elements 44. Those portions of the slot 18 may be venting portions, and may contribute to the ability to vent air from between the user and the protective portion 12.

To remove the brim 20 from the slot 18, the user must apply a force, which causes friction elements 44 to flex and bend from their forwardly bent position, to a rearwardly bending position to allow for removal of the brim 20 from the slot 18.

The exemplary embodiment depicted in FIG. 12 includes five fingers or friction elements 44 equally spaced and integrally formed with the primary panel 12 and extending from the primary panel 12 toward the suspension strap portion 24. It is understood that as few as one friction element 44, and more than five friction elements 44 may be incorporated into the protective face shield 10. Furthermore, although the friction elements 44 are shown as extending from the primary panel 12, it is understood that in an alternative embodiment, the friction elements 44 may extend from the suspension strap portion 24 toward the primary panel 12. In yet another embodiment, there may be a first set of friction elements 44 extending from the primary panel 12, and a second set of friction elements 44 extending from the suspension strap portion 24. The first and second sets of friction elements 44 may be arranged in a laterally staggered, alternating arrangement, such that a given friction element 44 of the first set resides between a pair of adjacent friction elements 44 in the second set.

The configuration of the slot 18 shown in FIG. 12, including the friction elements 22, may be particularly desirable for hard hats or bump caps made from plastics. Although, it is understood that the use of the face shield 10 shown in FIG. 12 is not limited thereto.

Figure 13:
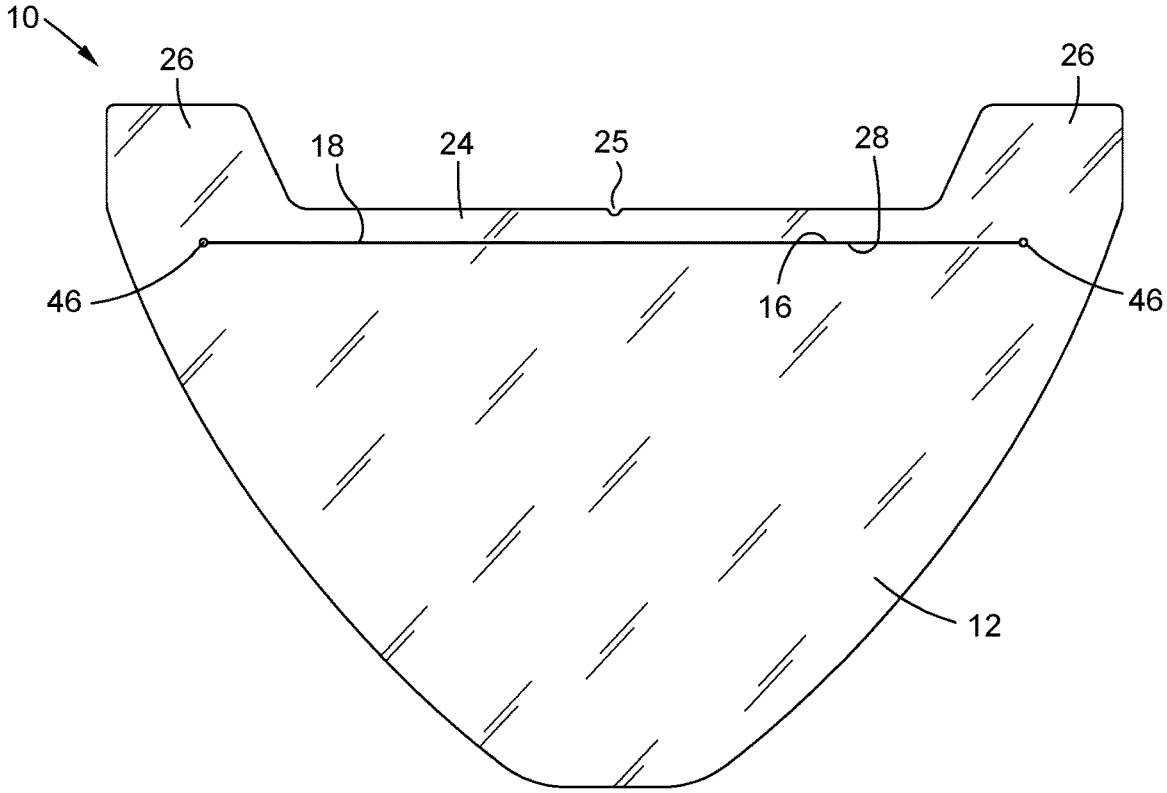
FIG. 13 is a front view of another embodiment of a protective face shield having a brim-receiving slit.

In FIG. 13, the slot 18 incorporated into the protective face shield 10 is in the form of a slit, and thus, is narrower than the slots 18 shown in FIGS. 1-7. In this regard, the term slot 18, as used herein, is intended to broadly encompass the configurations shown in FIGS. 1-8, including the slit. The slit 18 is generally linear and is defined by a lower edge 28 of the suspension strap portion 24 and an upper edge 16 of the protective portion 12. In one embodiment, the lower edge 28 may contact the upper edge 16 when the protective face shield 10 is not being used, e.g., is not attached to a brim 20 of a cap or headgear 22. In another embodiment, the lower edge 28 may be slightly spaced from, but reside immediately adjacent to, the upper edge 16.

At the opposite ends of the slit 18 are relief openings 46 that relieve internal stress buildup within the protective face shield 10 adjacent the slit 18 that may occur during advancement of a brim 20 through the slit 18 to mitigate tearing or breakage of the protective face shield 10.

When a brim 20 is advanced through the slit 18, the lower portion of the suspension strap portion 24 and the upper portion of the protective portion 12 will flex forwardly toward the front of the brim 20 to enhance friction between the brim 20 and the protective face shield 10. Thus, the enhanced friction may anchor the protective face shield 10 in a desired position on the brim 20. To remove the brim 20, the lower end of the suspension strap portion 24 and/or the upper end of the protective portion 12 may flex rearwardly to allow for removal of the brim 20 from the slit 18.

Figure 14:
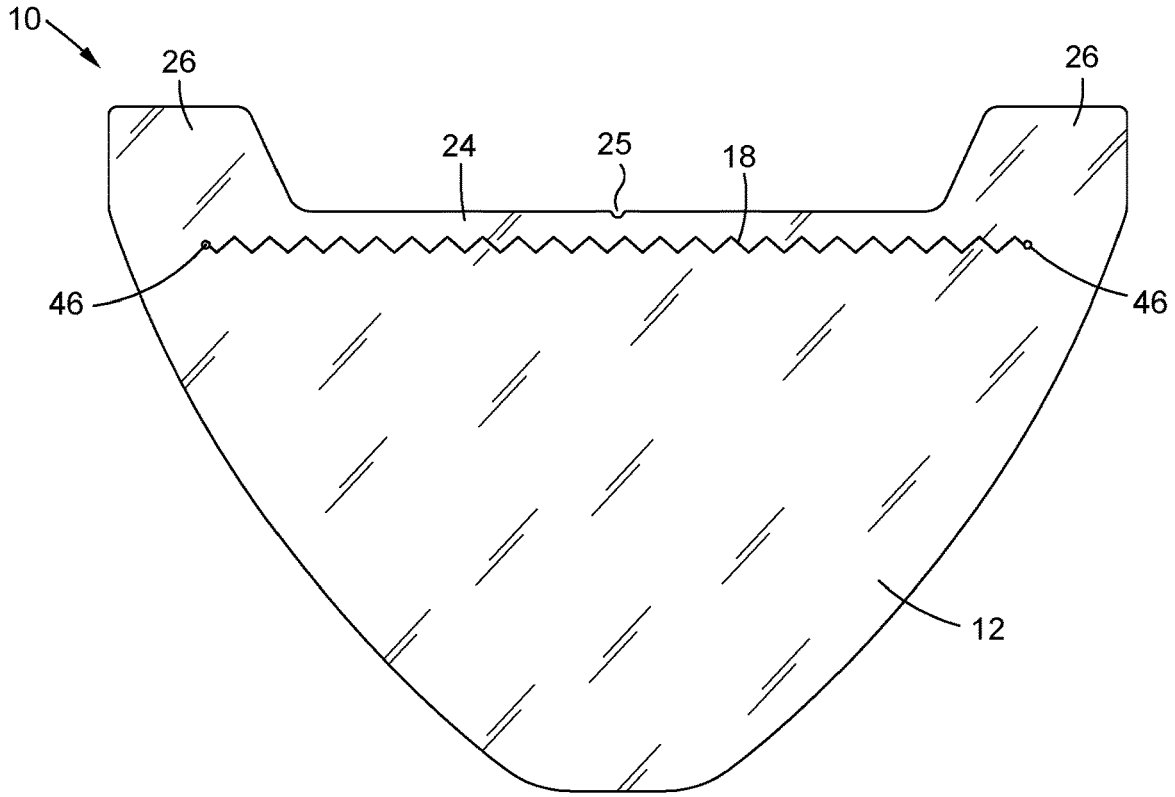
FIG. 14 is a front view of another embodiment of a protective face shield having a brim-receiving slot in a saw-tooth configuration.
Figure 15:
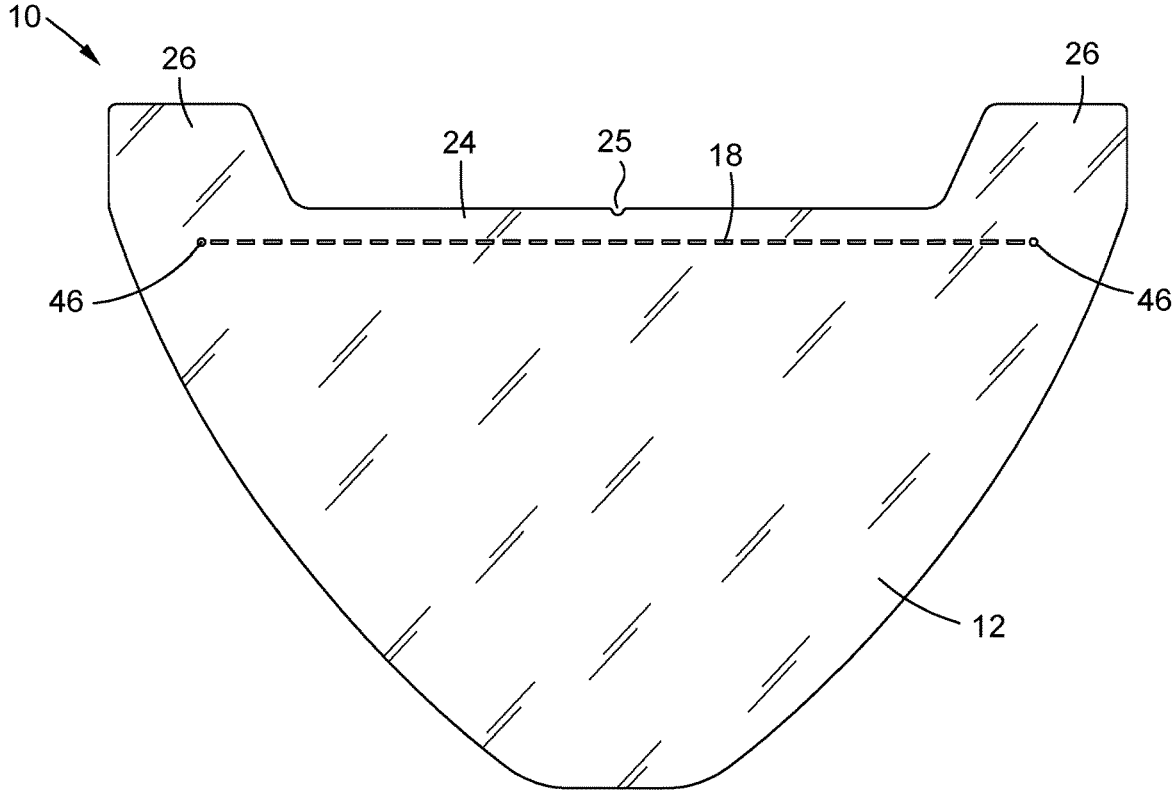
FIG. 15 is a front view of another embodiment of a protective face shield having a perforated slot to allow for customization of an effective length thereof.

FIGS. 14 and 15 show two additional configurations of the slot 18. In FIG. 14, the slot 18 is a saw-tooth configuration, which defines a series of peaks and valleys as the slot 18 extends across the face shield 10. The saw-tooth configuration may be particularly suitable for use with fabric hats, wherein the teeth of the slot 18 may dig into the fabric on the brim 20 to enhance the grip between the face shield 10 and the brim 20.

FIG. 15 shows a slot 18 that is perforated to allow for customization of the effective slot length. The slot 18 may be kiss-cut to include a series of openings that are spaced from each other prior to use. Upon initial installation of the face shield 10 onto the hat 22, a user may tear through some of the perforations to lengthen the effective size of the slot to match the size of the brim 20. As such, the perforations may facilitate use of the face shield 10 with several different hat sizes and configurations.

The bottom contour of the exemplary face shields 10 depicted in Figures include rounded configurations (e.g., FIGS. 1-5) and flat configurations (e.g., FIGS. 6-8 and 12-15). In this regard, the scope of the present disclosure encompasses both configurations, and is not limited to any single configuration.

It is understood that any dimension or value provided herein may be associated with an industry accepted mechanical or optical tolerance.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A protective shield for use with headwear having a brim and a crown portion, the headwear being wearable by a user, the protective shield comprising:

a panel having:

an upper linear edge;

an elongate slot formed in the panel and sized to receive the brim of the headwear to facilitate attachment of the protective shield to the headwear;

an upper suspension strap portion beginning at the upper linear edge;

a lower protective portion configured to extend over the user's eyes, nose, and mouth when the protective shield is attached to the headwear, the lower protective portion and upper suspension strap portion being on opposite sides of the elongate slot, with the upper suspension strap portion being positioned in an upward direction relative to the lower protective portion; and at least one lateral tab engageable with the headwear and extending from the upper linear edge in the upward direction relative to the upper suspension strap portion;

the panel being configured to be engageable with the headwear such that when the panel is engaged with the headwear, the elongate slot is advanced over the brim of the headwear with the brim of the headwear being received within the elongate slot and the at least one lateral tab is engaged with the crown portion of the headwear.

2. The protective shield recited in claim 1, wherein the at least one tab includes an adhesive to facilitate engagement with the headwear.

3. The protective shield recited in claim 1, wherein the upper suspension strap portion includes a lower edge opposing the upper linear edge to define a strap height between the upper linear edge and the lower edge, the strap height being between 0.20 inches and 0.40 inches.

4. The protective shield recited in claim 1, wherein the panel has a haze level that is less than 2%.

5. The protective shield recited in claim 1, further comprising a layer of silver disposed on the panel.

6. The protective shield recited in claim 1, wherein the upper suspension strap portion includes a lower edge and the lower protective portion includes an upper edge, a slot height being defined as a distance between the lower edge and the upper edge, the slot height being between 0.05 inches-0.13 inches.

7. The protective shield recited in claim 1, wherein the elongate slot is sized to include a region that extends below the brim when the brim is received within the elongate slot, such that the region facilitates ventilation in an area between the user and the lower protective portion.

8. The protective shield recited in claim 1, wherein the lower protective portion or the upper suspension strap portion includes friction elements extending into the elongate slot to facilitate frictional engagement with the brim when the brim is inserted into the elongate slot.

9. The protective shield recited in claim 1, wherein the upper suspension strap portion and the lower protective portion are configured such that a lower edge of the suspension strap portion contacts an upper edge of the protective portion when the brim is removed from the elongate slot, and the lower edge of the upper suspension strap portion is spaced from the upper edge of the lower protective portion when the brim is received within the elongate slot.

10. The protective shield recited in claim 1, wherein the at least one lateral tab includes a pair of lateral tabs, the protective shield further comprising a centering notch formed on the upper suspension strap portion and positioned equidistant from each of the pair of lateral tabs.

11. The protective shield recited in claim 1, wherein the elongate slot is linear.

12. A protective shield for use with headwear having a brim a crown portion, the protective shield comprising:

a unitary panel having an upper linear edge, a slot, an upper region beginning at the upper linear edge, a lower region, and at least one lateral tab, the upper region and the lower region being separated by the slot, with the upper region and being positioned in an upward direction relative to the lower region, the slot being sized to receive the brim of the headwear, the upper and lower regions being positioned on opposite sides of the brim when the brim is received within the slot, the lower region being sized to extend over the eyes, nose and mouth of a user when the brim is received in the slot and the headwear is worn on the user's head, the at least one tab extending from the upper linear edge in the upward direction relative to the upper region and being engageable with the headwear;

the panel being configured to be engageable with the headwear such that when the panel is engaged with the headwear, the slot is advanced over the brim of the headwear with the brim of the headwear being received within the slot and the at least one lateral tab is engaged with the crown portion of the headwear.

13. The protective shield recited in claim 12, wherein the upper region includes a lower edge opposing the upper linear edge to define a height therebetween, the height being between 0.20 inches and 0.40 inches.

14. The protective shield recited in claim 12, wherein the panel has a haze level that is less than 2%.

15. The protective shield recited in claim 12, wherein the lower region or the upper region includes friction elements extending into the slot to facilitate frictional engagement with the brim when the brim is inserted into the slot.

16. The protective shield recited in claim 12, wherein the upper region and the lower region are configured such that a lower edge of the upper region contacts an upper edge of the lower region when the brim is removed from the slot, and the lower edge of the upper region is spaced from the upper edge of the lower region when the brim is received within the slot.

17. The protective shield recited in claim 12, further comprising a peripheral frame coupled to the unitary panel adjacent a peripheral edge of the unitary panel, the peripheral frame being bendable and configured to assume a desired configuration.

18. A protective shield for use with headwear having a brim and a crown portion, the protective shield comprising:

a unitary panel having an upper linear edge, a slot, an upper region beginning at the upper linear edge, a lower region, and at least one lateral tab extending from the upper linear edge in an upward direction relative to the upper region and including an upper tab edge, the upper region and the lower region being separated by the slot, the slot being sized to receive the brim of the headwear, the upper and lower regions being positioned on opposite sides of the brim when the brim is received within the slot, the lower region being sized to extend over the eyes, nose and mouth of a user when the brim is received in the slot and the headwear is worn on the user's head, the at least one tab being engageable with the headwear and the upper tab edge being offset from the upper edge;

the panel being configured to be engageable with the headwear such that when the panel is engaged with the headwear, the slot is advanced over the brim of the headwear with the brim of the headwear being received within the slot and the at least one lateral tab being engaged with the crown portion of the headwear.

19. The protective shield recited in claim 18, wherein the at least one tab includes a side edge extending from the upper linear edge in non-parallel relation to the upper linear edge.

20. The protective shield recited in claim 18, wherein the slot is linear.

* * * * *